United States Patent [19]

Janniere et al.

[11] Patent Number: 4,956,528

[45] Date of Patent: Sep. 11, 1990

[54] PUSHBUTTON SWITCH

[75] Inventors: Alain Janniere, Paris; Bernard Juret, Dole, both of France

[73] Assignee: ITT Composants et Instruments, Bagnuex, France

[21] Appl. No.: 331,567

[22] Filed: Mar. 30, 1989

[30] Foreign Application Priority Data

Apr. 6, 1988 [FR] France ..... 88 04549

[51] Int. Cl.[5] ..... H01H 13/14

[52] U.S. Cl. ..... 200/314; 200/248; 200/530

[58] Field of Search ..... 200/314, 532, 530, 534, 200/535, 345, 243, 248, 530, 532

[56] References Cited

U.S. PATENT DOCUMENTS

| | | | |
|---|---|---|---|
| 1,353,249 | 9/1920 | Lee | 200/530 |
| 3,892,934 | 7/1975 | Richards et al. | 200/243 |
| 3,988,557 | 10/1976 | Francke et al. | 200/314 |
| 4,142,168 | 2/1979 | Natland | 200/314 X |
| 4,514,609 | 4/1985 | Fricke et al. | 200/532 |

FOREIGN PATENT DOCUMENTS

| | | | |
|---|---|---|---|
| 0077927 | 9/1982 | European Pat. Off. . | |
| 2419649 | 11/1975 | Fed. Rep. of Germany . | |
| 3447622 | 10/1985 | Fed. Rep. of Germany . | |
| 1234755 | 10/1960 | France | 200/248 |
| 2468197 | 10/1980 | France . | |
| 2042271 | 9/1980 | United Kingdom . | |
| 20991490 | 7/1982 | United Kingdom . | |

*Primary Examiner*—Renee S. Luebke

*Attorney, Agent, or Firm*—Thomas L. Peterson

[57] ABSTRACT

An electrical contact switch for mounting on a printed circuit board, having a base provided with contacts, an illuminated cover movable with respect to the base and arched coil springs on the base arranged transversely to the direction of movement of the cover which resist downward movement of the cover. A shoe joined to the cover is guided for limited movement toward the base and is provided with contacts that engage the contacts on the base.

9 Claims, 3 Drawing Sheets

PUSHBUTTON SWITCH

BACKGROUND OF THE INVENTION

The present invention relates to an electrical contact switch intended to be mounted, in particular, on a printed circuit board.

There are numerous applications for which industry seeks switches which combine reliability and constant switching force over a long life in a design that is simple, economical, and of small size.

Moreover, for certain applications it is necessary for the upper face of the switches to be illuminated internally. Mounting the switches in position must also be simple.

It is also desirable to have a modular switch which can easily be mounted on a previously prepared printed circuit board and whose structure is such that the function of the external housing of the switch is reduced merely to the function of masking and not the function of guiding.

There is known a push-button switch having a resilient element of rapid action, which is described in French Patent No. 2,468,197, which partially fulfills the above-mentioned conditions. Such a switch has a particularly long, useful life due to a special arrangement and to the use of a helical spring arranged transversely to the direction of movement of the push-button.

Although such prior switch has certain advantages, it also has disadvantages. There is no provision for illumination of the front face of the push-button. The switch has a pusher that is guided by the cover of the casing and by a fork in its lower part. The forces exerted on the push-button, when they are not precisely on the axis of the pusher, can bring about premature wear of the guiding means. Premature wear of the guiding means may lead to the introduction of foreign material inside the casing in the form of dust, which can lead to poor functioning of the switch.

A principal object of the present invention is to provide an electrical contact switch intended to be mounted on a printed circuit board, which overcomes disadvantages of the known switches.

SUMMARY OF THE INVENTION

According to the invention, there is provided an electrical switch comprising a base provided with electrical contacts, a cover which is movable with respect to the base and has means for illumination, electrical connections for the illumination means, and at least one arched resilient element arranged substantially transversely to the direction of movement of the cover and cooperating with the cover. A shoe which is joined to the cover cooperates with a means for guiding and for limiting the movement of the shoe relative to the base. The shoe is provided with electrical contacts arranged opposite the electrical contacts on the base along the direction of movement of the cover.

DESCRIPTION OF THE PREFERRED EMBODIMENTS

Figure 1:
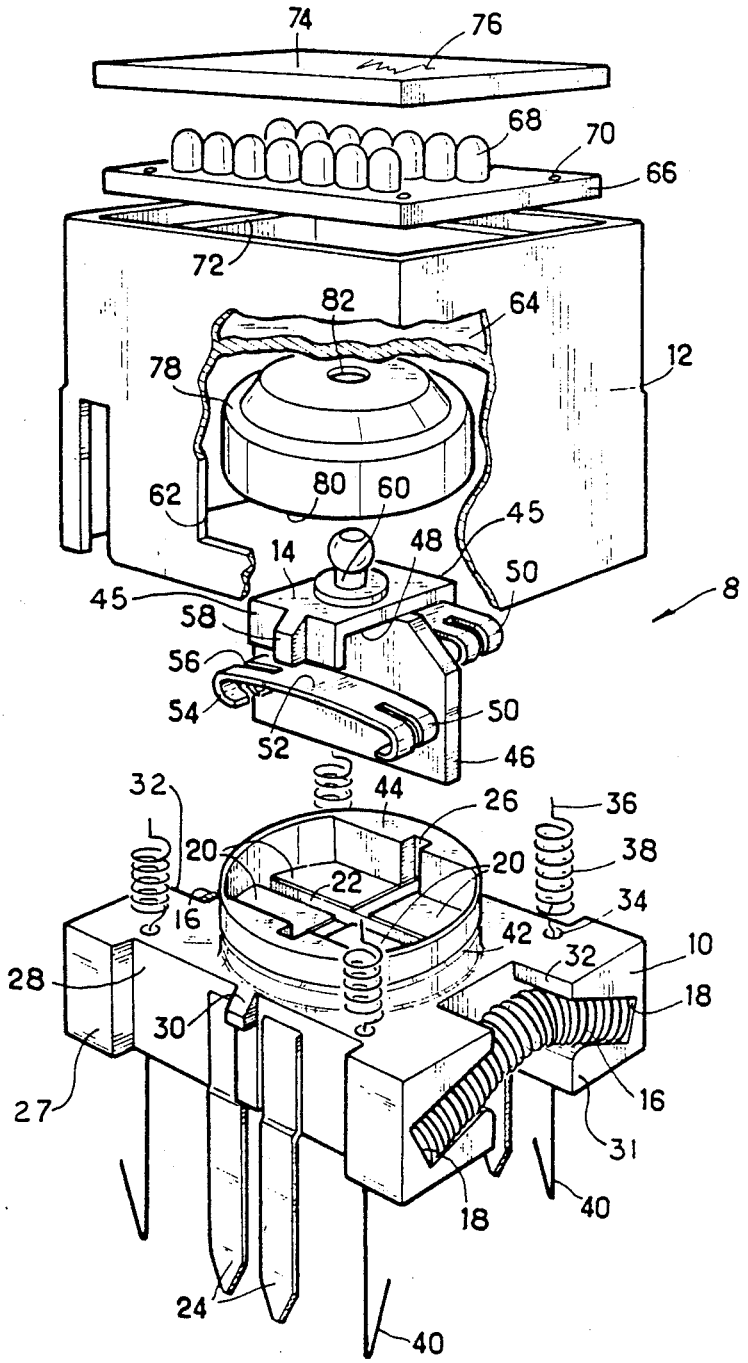
FIG. 1 is an exploded perspective view of a switch according to the invention, with part of the switch cover removed.

FIG. 1 shows the three principal subassemblies of the switch 8 according to the invention, namely, a base 10, a cover 12, and a shoe 14, each of which is preferably formed of plastic.

The base 10, which is of substantially rectangular shape, has two springs 16 of the helical type which are arched upwards. The ends of the springs are received in seatings 18 inclined with respect to the horizontal plane of the base so as to orient the arching of the spring upwards. The base also has four electrical contacts or fixed blocks 20 situated on opposite sides of a longitudinal groove 22. The contacts 20 extend below the base 10 to form pins 24.

A complementary groove 26 is formed in the base which is perpendicular to the first groove 22. The longitudinal side walls 27 of the base each have a recess 28, substantially in the center of which there projects a retaining stop 30. The stop is molded in one piece with the base. The transverse side faces 31 of the base also have recesses 32 through which pass the helical springs 16. Hence the springs are accessible from above the base. The base 10 is provided with four vertical bores 34, through which pass electrical supply connection 36. The upper end of each connection 36 is in the form of a noncontiguous helical spiral 38, while the lower part 40 is bent into a J shape in order to form a pin. An annular groove 42 is formed in the upper cylindrical part 44 of the base.

The shoe 14 has a U shape. The lower or open side of the shoe is oriented opposite the base 10, and it has in its center, parallel to its arm 45, a rib 46 of a height greater than that of the arms, thus separating the lower side of the shoe into two seatings or recesses 48. Leaf springs 50 of a C-shaped profile are mounted in the seatings 48, although one spring is shown below the seating in FIG. 1. The central parts 52 of the springs are introduced with slight force into the seatings 48, in which they are frictionally held, while the curved ends 54 extend laterally beyond the seatings 48. Each spring comprises a leaf. Notches 56 are made in the curved ends 54 of these springs so as to form a double contact. The shoe also has two lateral lugs 58 on the outside of the arms 45 and a pivot pin 60 which projects upwardly from the shoe.

The cover 12 which serves as a push button is of rectangular shape, and its dimensions are such that its side walls are disposed outside the base 10 and are slidable with respect to the base.

As seen in FIG. 1, the cover has an opening 62 near the middle of one of its side walls. The cover 12 also has an interior support plate 64 which receives a printed circuit board 66 on which are arranged light-emitting diodes 68. The diodes are arranged in two parallel series along the longitudinal axis of the board 66. The board 66 is provided with holes 70 through which the upper ends of the supply connections 36 extend.

The cover has an interior ledge 72 above the plate 64. A transparent or at least translucent mask 74 is mounted on the ledge. The mask carries a pictogram 76 of the function which can be executed by means of the switch according to the invention.

In FIG. 1, there is also shown a sealing membrane 78 located between the shoe 14 and the support plate 64 which is connected to the cover 12. The diameter of the membrane is sufficient to cover the upperr cylindrical part of the base 10. The membrane has an inwardly extending annular flange 80 mounted in the groove 42. In its upper part, the membrane 78 has a bore 82 through which the pivot pin 60 extends.

Figure 2:
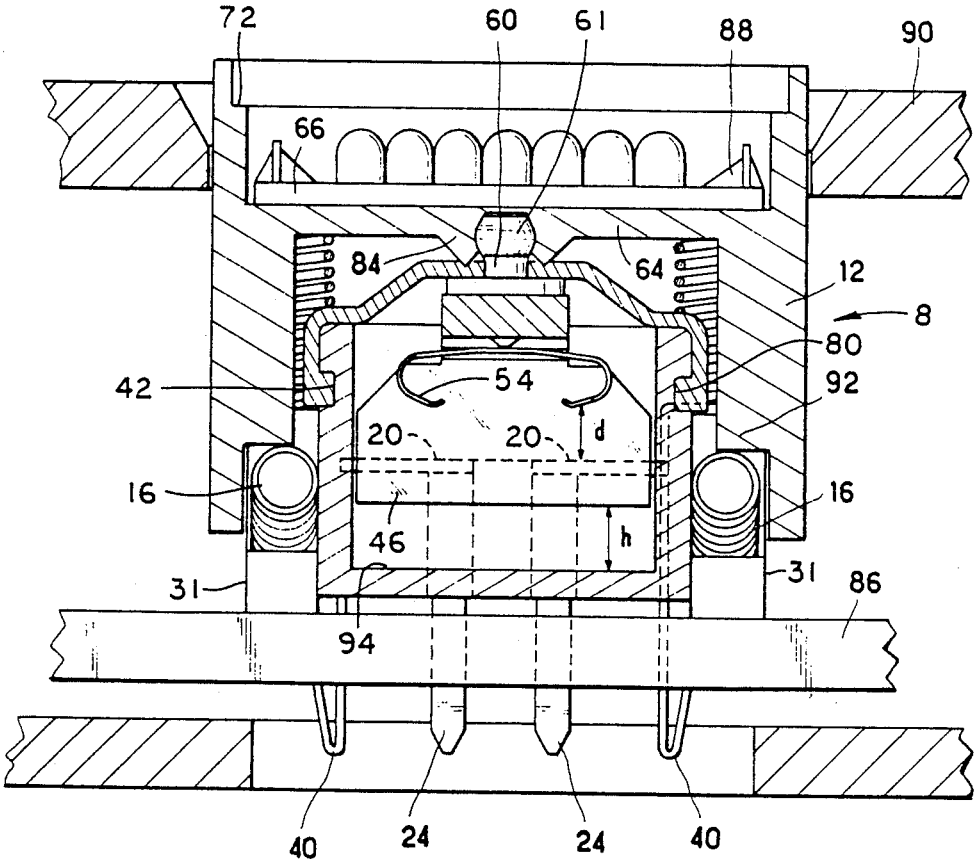
FIG. 2 is a sectional view of the switch shown in FIG. 1 taken along a longitudinal vertical central plane.
Figure 3:
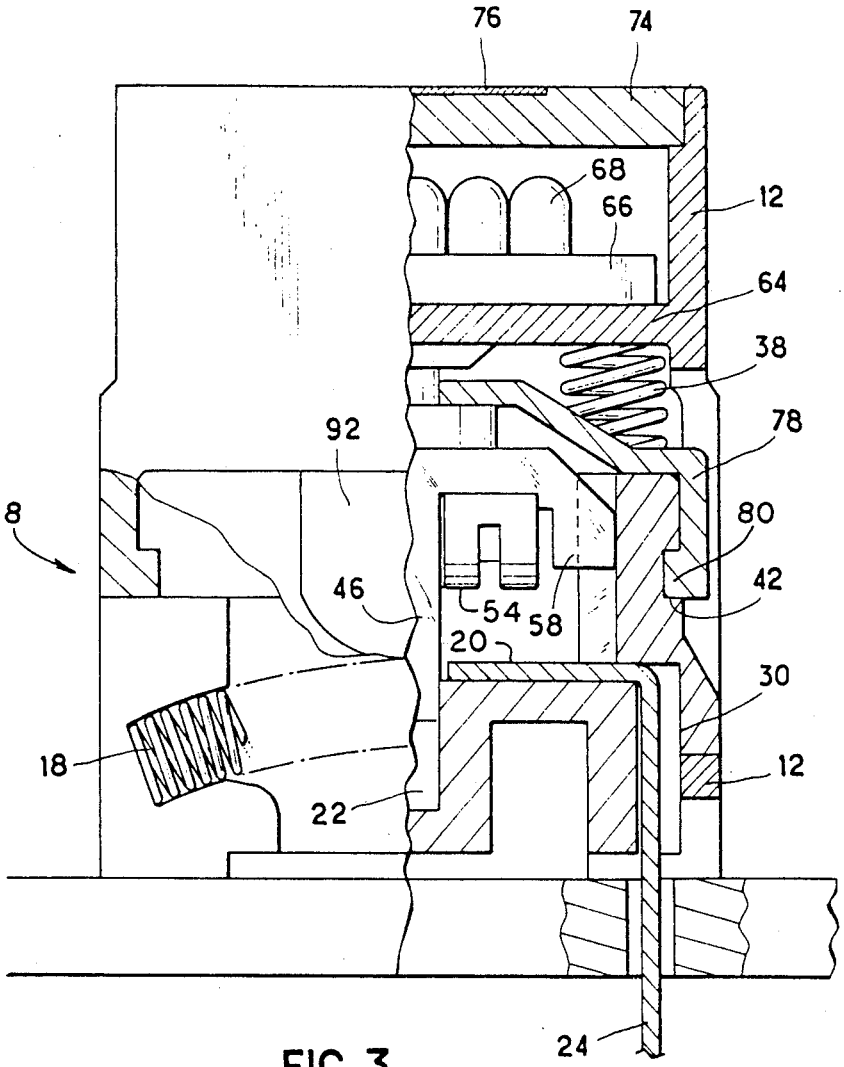
FIG. 3 shows, on the right-hand side, a sectional view along a transversal central plane and, on the left-hand side, an elevation with some parts removed.

With reference to FIG. 2, a hollow female part or socket 84 is formed on the bottom of support plate 64 which cooperates with the head 61 of the pivot pin 60. This results in the shoe 14 being loosely mounted on the push button or cover, in that the pin head 61 can pivot to allow the bottom of the shoe and the contacts 50 to shift position horizontally with respect to the push button. FIG. 2 also shows a printed circuit board 86 intended to receive the switch according to the invention. The switch is fastened to the board by soldering the pins 24 to the board. The lower ends 40 of the supply connections 36 are also soldered to the board 86 so as to enable electric current to pass into the diode support plate 66. The upper ends of the connections 36 are soldered at 88 to the same plate. FIG. 2 also shows the external covering 90 of the apparatus in which the modular switch according to the invention is arranged.

As seen in FIG. 2, lugs 92 are formed on the inside of the cover side walls. The lugs lie in the recesses 32 and bear against the middle of the arched springs 16.

The assembly of the switch according to the invention is effected in the following way. The printed circuit board 66 provided with the diodes 68 and connections or springs 36 are mounted on the support plate 64. The supply connections 36 are then fastened by soldering at their upper ends to the board 66. The contacts 50 are slid into the seatings 48 of the shoe 14 until they latch in. Similarly, the mask 74 is fastened to the upper part of the cover 12. The base 10 is provided with its helical springs 16 and receives in its grooves 22 and 26 the rib 46 and the lugs 58 of the shoe 14, respectively. The head 61 of the pin 60 is passed through the bore 82 in the sealing membrane 78, and the flange 80 of the membrane 78 is positioned in the groove 42 in the upper part 44 of the base 10. The base 10 is then introduced into the cover 12 until the head 61 of the pivot pin is pressed into the socket 84 by deflection of resilient material of the socket until the head latches in.

The lower ends or pins 40 of the connection devices 36 are passed through the bores 34 in the base 10 and project out of the lower part of the base.

The assembly of the switch according to the invention on the printed circuit board 86 is effected in a simple manner by inserting the pins 24 and 40 into the board 86 and by fastening the latter, for example, by welding spots or soldering.

The operation of this switch is reliable and simple, as will be described below.

The user exerts a pressure on the upper face of the switch 8 and, more particularly, on the mask 74, which moves down the cover 12 with respect to the base 10. The cover 12 drives down the shoe 14 which is joined to the cover 12. The lugs 92 on the cover 12 bear against the springs 16. The user must therefore overcome the resistant force of the springs 16 which, in the example shown, is of the order of 250 gM per spring. Each supply connection 36 has negligible resistance to compression, as compared to that of the helical springs 16 and thus the connections 36 do not appreciably affect depression of the cover. The rib 46 and the lugs 58 slide respectively in the grooves 22 and 26. As can be seen in FIG. 2, the distance "h" separating the lower part of the rib 46 from the bottom 94 of the groove 22 is slightly greater than the distance "d" which separates the lower part of the curved parts 54 of the spring leaves 52. When the spring leaves 52 press firmly on the contacts 20, the bottom of the rib 46 abuts the bottom 94 of groove 22, thus avoiding plastic deformation of the leaves 52.

When the rib 46 abuts the bottom of the groove 22, the helical springs 16 are resiliently deflected into a substantially M-shaped profile. As soon as the user releases the pressure exerted on the cover 12 via the mask 74, the springs tend to reassume their initial arch and thus repel the cover 12 upwards. This lifts the shoe 14 and the contacts 50 thereon to separate the contacts 50 and 20. The curved parts 54 of the spring leaves thus reassume their initial profile because of the inherent resilience of the material of which they are made.

The cover 12 pushed by the spring 16 moves away from the base 10 until the retaining stop 30 comes into contact with the lower edge of the opening 62 made in the cover 12, thus preventing the cover 12 and the base 10 from becoming separated.

In this position, the lower end of the rib 46 on the shoe is always in contact with the groove 22 and the rib remains guided, while the side walls of the cover 12 also surround the base 10 at one part of its height.

The switch according to the invention thus has numerous advantages, in particular close guiding of cover 12 in sliding with respect to the base 10. The shoe 14 which holds the contacts 50 is independently guided in sliding movement, so manufacturing tolerances do not add to cause misalignment of the contacts 50, 20. Because of the helical shape of the supply connections, they can undergo a great many cycles, bringing about a very long life for the switch.

The light-emitting diodes 68 enable illumination of one row or the other, or of both together, as desired. This illumination is effected with limited emission of heat.

Furthermore, the membrane 78 ensures complete sealing during the movement of the shoe 14 in the base 10, thus avoiding any penetration of water, dust, or any other element which might impair the good functioning of the electrical contacts. The electrical contacts must be kept clean and water must not accumulate in the upper part of the base 10 so that the circuit-breaking ability of the switch is maintained.

Such a sealing membrane has an important function in particular in the case where this switch is used in atmospheres or in applications such as aviation where the reliability requirements are high.

It is seen that the assembly of this switch is effected in a simple manner. The cover 12 is joined by means of the pivot pin 60 and latched onto the retaining stops 30 of the base 10.

The switch according to the invention consists of a single module which, once assembled, can be easily installed on printed circuit boards such as 86.

The switch according to the invention does not require further adjustment with respect to the covering 90, since movement of the switch parts is independent of the latter. This ease of assembly brings about a very low cost for the assembled switch.

The embodiment which has just been described has two contacts 50, four fixed block contacts 20, and two rows of light-emitting diodes 68. This double input/-double output switch can be used to act in a single circuit or in two independent circuits, which correspondingly increases its versatility of use.

Although several embodiments of the invention have been disclosed herein for purposes of illustration, it will be understood that various changes can be made in the form, details, arrangement and proportions of the various parts in such embodiments without departing from the spirit and scope of the invention as defined by the appended claims.

What is claimed is:

1. An electrical contact switch adapted to be mounted on a printed circuit board comprising:
- a base having electrical contacts;
- a cover over said base movable in a predetermined direction with respect to said base and including illumination means;
- electrical connection means for carrying current to said illumination means;
- at least one arched resilient element arranged substantially transversely to said predetermined direction seated in said base, said resilient element cooperating with said movable cover to resiliently resist movement of said cover in said predetermined direction;
- a shoe coupled to said cover and lying between said base and said cover;
- said shoe having electrical contacts positioned opposite said base contacts to engage said base contacts upon movement of said cover in said predetermined direction;
- guide means for guiding and limiting movement of said shoe relative to said base in said predetermined direction, said guide means including a groove in said base and a rib extending downwardly from said shoe and being slideable in said groove.

2. A switch as set forth in claim 1 wherein:
- said shoe has two lateral lugs arranged on opposite sides of said rib and extending in a direction perpendicular to the longitudinal axis of the said rib so as to ensure complementary guiding of said shoe relative to said base, said lugs being slideable in cooperating grooves in said base.

3. An electrical contact switch adapted to be mounted on a printed circuit board comprising:
- a base having electrical contacts;
- a cover movable in a predetermined direction with respect to said base and having illumination means;
- electrical connection means for carrying current to said illumination means;
- at least one arched resilient element arranged substantially transversely to said predetermined direction seated in said base, said resilient element cooperating with said movable cover to resiliently resist movement of said cover in said predetermined direction;
- a shoe coupled to said cover and lying between said base and said cover, said shoe having electrical contacts positioned opposite said base contacts to engage said base contacts upon movement of said cover in said predetermined direction;
- guide means for guiding and limiting movement of said shoe relative to said base in said predetermined direction;
- said illumination means are light-emitting diodes on a printed circuit board mounted in said cover; and
- said electrical connections are spring elements, one end of each said spring element being fastened to said printed circuit board carrying said light-emitting diodes and the other extending downwardly through bores in said base to form a pin.

4. A switch as set forth in claim 3 wherein:
- the resistance provided by said electrical connections to movement of said cover in said predetermined direction, is negligible with respect to the rigidity of said arched resilient element.

5. An electrical contact switch adapted to be mounted on a printed circuit board comprising:
- a base having electrical contacts;
- a cover movable in a predetermined direction with respect to said base and having illumination means;
- electrical connection means for carrying current to said illumination means;
- at least one arched resilient element arranged substantially transversely to said predetermined direction seated in said base, said resilient element cooperating with said movable cover to resiliently resist movement of said cover in said predetermined direction;
- a shoe coupled to said cover and lying between said base and said cover, said shoe having electrical contacts positioned opposite said base contacts to engage said base contacts upon movement of said cover in said predetermined direction;
- guide means for guiding and limiting movement of said shoe relative to said base in said predetermined direction;
- said arched resilient element has a single stable position tending to move said cover away from said base.

6. A switch as set forth in claim 5 wherein:
- said resilient element is an upwardly arched helical spring of which one part is curved in said predetermined direction so as to form an M when said shoe reaches its limit of movement relative to said base, said spring in said M form being unstable.

7. A push button switch that is adapted to be mounted on a printed circuit board, comprising:
- a base member having at least one contact;
- a push button slideable in predetermined first and second opposite directions on said base member;
- a spring urging said push button in said second direction relative to said base member;
- a shoe member mounted on said push button to move in said first and second directions with said push button respectively toward and away from said base member, said shoe member lying between said push button and said base member;
- at least one contact mounted on said shoe member and positioned opposite said base contact to engage said base contact upon movement of said push button in said first direction;
- said shoe member being loosely mounted to said push button to allow at least said shoe contact to shift position relative to said push button in a direction perpendicular to said first and second directions; and
- a guide which extends from said shoe member directly in said first direction to a location on said base member which lies adjacent to said base contact, with said guide being mounted on one of said members and being slideably engaged with the other member.

8. The switch described in claim 7 wherein:
- said push button has a socket and said shoe has a head lying in said socket.

9. The switch described in claim 7 including:
- a flexible sealing membrane disposed about and sealed to portions of said shoe and base that include said shoe contact and said base contact.

* * * * *